US005156486A

United States Patent [19]

Davidson

[11] Patent Number: 5,156,486

[45] Date of Patent: Oct. 20, 1992

[54] TRAFFIC CONTROL MARKER AND METHOD OF MAKING THE SAME

[76] Inventor: Carl E. Davidson, 5821 Aptos View Rd., Aptos, Calif. 95003

[21] Appl. No.: 636,886

[22] Filed: Jan. 2, 1991

[51] Int. Cl.[5] ..... E01F 9/01; E01F 13/00

[52] U.S. Cl. ..... 404/10; 404/6; 404/9; 116/63 P; 52/DIG. 9; 29/401.1; 29/403.1

[58] Field of Search ..... 404/6, 9, 10-12, 404/14-16; 256/13.1; 116/63 R, 63 P; 248/904, 347; 40/606, 608, 610, 612; 264/138, 145, 157, 339; 52/DIG. 9; 29/401.1, 403.1; 405/211, 212, 215

[56] References Cited

U.S. PATENT DOCUMENTS

| | | | |
|---|---|---|---|
| 2,199,845 | 5/1940 | Wolf | 29/401.1 |
| 2,208,080 | 7/1940 | Overdorff | 404/15 |
| 3,038,512 | 6/1962 | Staton | 29/401.1 |
| 3,475,009 | 10/1969 | Brown | 116/63 P |
| 3,621,611 | 11/1971 | Wingerter | 29/401.1 |
| 3,692,281 | 9/1972 | Clayton | 52/DIG. 9 |
| 3,928,701 | 12/1975 | Roehner | 404/6 |
| 3,954,346 | 5/1976 | Miller | 404/16 |
| 4,022,434 | 5/1977 | Moore | 404/6 |
| 4,186,913 | 2/1980 | Bruner et al. | 404/6 |
| 4,785,577 | 11/1988 | Lederbauer | 405/284 X |

FOREIGN PATENT DOCUMENTS

| | | | |
|---|---|---|---|
| 2125863 | 3/1984 | United Kingdom | 404/9 |

*Primary Examiner*—William P. Neuder
*Attorney, Agent, or Firm*—Paul B. Fihe

[57] ABSTRACT

A traffic control marker and marker base is described taking the form of a dome-shaped resilient body member whose ends lie in a flat plane and whose sides are outwardly flared. The marker can be formed by cutting a used pneumatic tire into arcuate segments, each of which can be forcefully inverted to automatically provide such body member. In many circumstances, the bodies alone, colored with eye-catching fluorescent or reflective coatings, can be effectively used for traffic control markers. And in other circumstances they can serve as a resilient light-weight base whereon various visual indicators such as a flag, sign, reflector, or light can be removably mounted in various ways to rise therefrom.

9 Claims, 1 Drawing Sheet fig_1
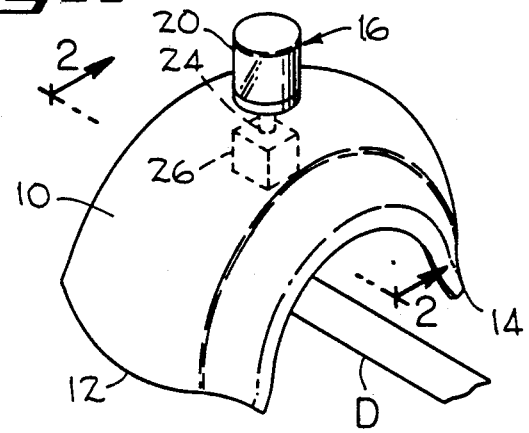
fig_2
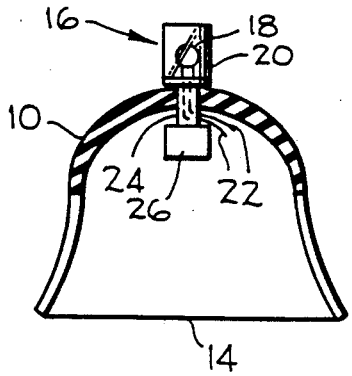
fig_3
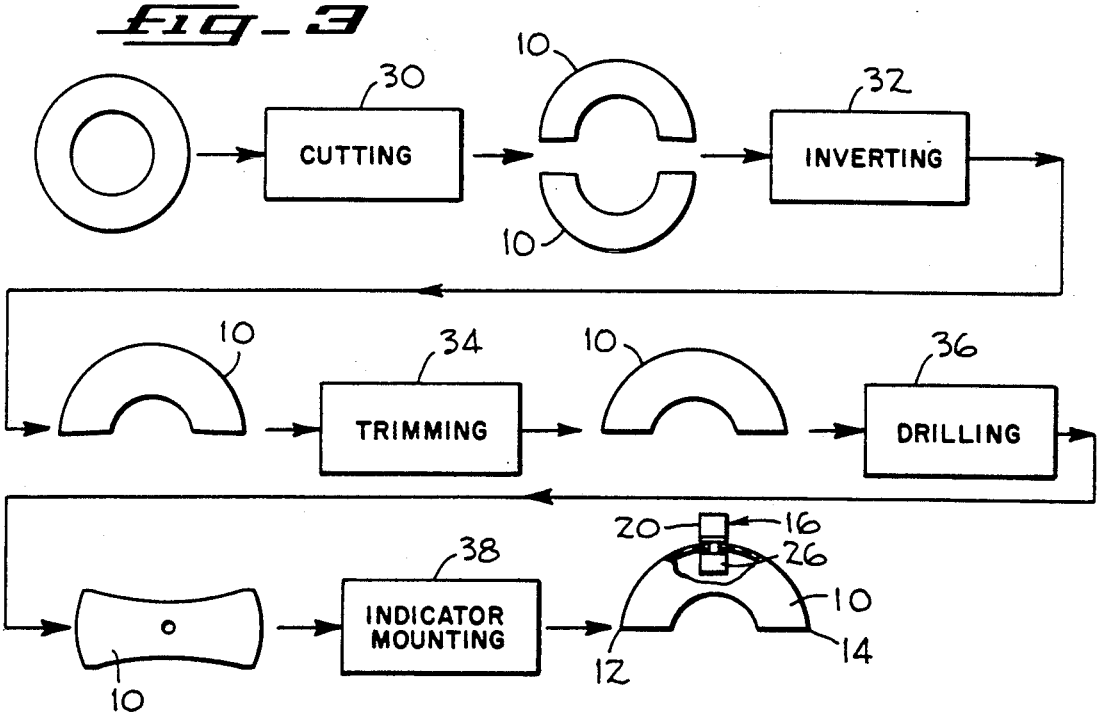
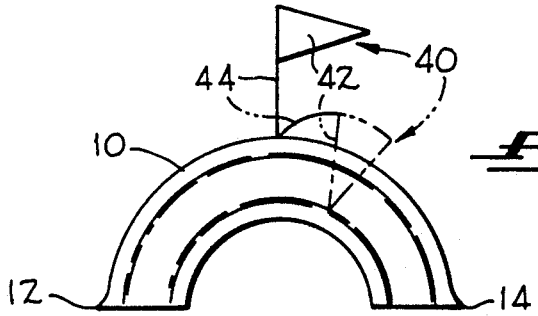
fig_4

TRAFFIC CONTROL MARKER AND METHOD OF MAKING THE SAME

FIELD OF THE INVENTION

The present invention relates to visual indicators and more particularly to a traffic control marker and to the method of making the same.

BACKGROUND OF THE INVENTION

When roadways are being painted or repaired, markers are employed to direct vehicular traffic into controlled traffic lanes, one common example being the resilient cone such as shown in U.S. Pat. No. 2,719,505. Albeit rather simple, it is manufactured specifically for this purpose and the cost is therefore relatively great, particularly when it is realized that frequently damage occurs and replacement is required.

SUMMARY OF THE PRESENT INVENTION

It is the general objective of the present invention to provide a traffic control marker and/or marker base which can be made from used (recycled) pneumatic tires, which are inexpensive for this purpose, and, also results in a great saving of this earth's resources.

To achieve this objective, a used resilient pneumatic vehicle tire is initially cut into at least two equal arcuate segments. Segments of lesser size down to one-quarter of the whole tire are satisfactory for this purpose. Next, each segment is forceably inverted so that the sides automatically flare outwardly to provide a stable support on the roadway or other surface. If required, the ends of the inverted tire segment can be trimmed so that they lie in a single flat plane.

The resulting configuration not only assures a stable support but the flared sides allow the markers to be "nest" stacked for compact storage and transport.

When needed to increase the height and/or visual enhancement of the marker, an upright flag or other various indicators may be attached to the marker.

The kinetic stresses set up when the resilient tire segment is inverted cause the segment to assume the correct domelike configuration and provide stability for this traffic control marker.

BRIEF DESCRIPTION OF THE DRAWING

The present invention, as summarized above, will be more fully understood by reference to the following detailed description of the illustrated embodiments of the invention shown in the accompanying drawing wherein:

FIG. 1 is a perspective view of a traffic control marker embodying the invention seated on a roadway in spanning relation over a freshly painted lane divider, FIG. 2 is a sectional view taken along line 2 - 2 of FIG. 1, FIG. 3 is a flow diagram indicating the method of making the marker, and FIG. 4 is a side elevational view of a modified embodiment of the invention.

DETAILED DESCRIPTION OF THE ILLUSTRATED EMBODIMENT OF THE INVENTION

With initial reference to FIGS. 1 and 2, the traffic control marker includes a body member 10 of an arcuate dome-shaped configuration with ends 12, 14 that lie in a single flat plane to allow support on a roadway or other surface. As an example, the body member 10 is illustrated in FIG. 1 as spanning a freshly-painted lane divider D so that its elevated central position does not contact the fresh paint. In transverse section, as shown in FIG. 2, the sides of the body member flare outwardly which configuration stabilizes support on a roadway.

The body member 10 is composed of resilient material and preferably is formed by an arcuate segment of an inverted vehicle pneumatic tire as described hereinafter.

The body member 10 can be colored with a reflective eye-catching coating. In addition, an indicator, generally shown at 16, is centrally mounted to rise from the body member 10, and as shown in FIGS. 1 and 2 takes the form of an electric bulb 18 housed within a resilient plastic cover 20 of translucent material and electrically connected by suitable leads 22 through a tube 24 that extends through a hole in the base member 10 for removable connection to a small battery 26. The battery weight holds the indicator 16 in substantially an upright position, as illustrated.

In accordance with an important aspect of the present invention, the body member 10 is formed from a portion of a used pneumatic vehicle tire which would otherwise be discarded and merely take up space in a garbage dump. Thus, the invention can provide a method of recycling an otherwise wasted and valueless resource.

As shown in FIG. 3, a used tire is initially cut 30 into at least two arcuate segments Each segment is then inverted 32 to automatically provide the body member 10 with aligned ends and outwardly flared sides as shown in FIGS. 1 and 2. If needed the ends can be trimmed 34 to insure that the ends lie in a single flat plane. A hole is next drilled 36 in the center of the body member 10 to permit mounting 38 of the described indicator 16.

If different size markers are preferred, it will be obvious that larger or smaller sizes of the used tires can be cut into three or more segments.

If nighttime use is not required, a simpler form of indicator 40, as shown in FIG. 4 can be used. An indicator flag 42 is mounted at the top of a resilient rod 44 connected in the body member hole to allow the flexibility indicated by phantom lines in FIG. 4.

Yet other alterations and/or modifications can be made without departing from the spirit of the invention and its actual scope is to be indicated only in the appended claims.

What is claimed is:

1. A traffic control marker which comprises a body member in the form of a curved configuration with its ends arranged to rest on a supporting roadway or other surface, said body member having a curved configuration in the form of an arcuate segment of a cut and inverted used tire.

2. A traffic control marker according to claim 1 wherein said body member is formed of resilient material.

3. A traffic control marker according to claim 1 wherein the ends of said body member lie in a single flat plane.

4. A traffic control marker according to claim 1 wherein the sides of said body member flare outwardly.

5. A traffic control marker according to claim 1 which comprises an indicator supported from said body member in an upright position.

6. A traffic control marker which comprises a body member arranged to rest on a supporting roadway or other surface, said body member having a curved configuration in the form of an arcuate segment of a cut and inverted used tire, a resilient member supported on said body member to normally rise upwardly therefrom but bendable towards a horizontal position, and a visual indicator supported at the top of said resilient member.

7. A traffic control member according to claim 6 wherein said body member constitutes a portion of a used vehicle tire.

8. The method of making a traffic control marker which comprises the steps of cutting a resilient pneumatic tire into at least two sections, each of which forms an arcuate segment, and inverting said tire segments to provide a curved configuration with outwardly flaring sides, and ends arranged to rest on a roadway.

9. The method of making a traffic control marker according to claim 8 which comprises the additional step of attaching an upright indicator to said inverted tire segment.

* * * * *